United States Patent [19]

Su

[11] Patent Number: 4,705,465

[45] Date of Patent: Nov. 10, 1987

[54] OIL-PRESSURE TRANSMISSION DEVICE

[76] Inventor: Ming H. Su, 21-1, Tzy Chih North 1 Rd., Fenq Shan City, Kaohsiung Hsien, Taiwan

[21] Appl. No.: 820,992

[22] Filed: Jan. 22, 1986

[51] Int. Cl.[4] ..... F01C 21/16; F01C 15/04

[52] U.S. Cl. ..... 418/23; 418/263; 418/264

[58] Field of Search ..... 418/23, 260–264, 418/267

[56] References Cited

U.S. PATENT DOCUMENTS

| | | | |
|---|---|---|---|
| 609,543 | 8/1898 | Herchert | 418/23 |
| 2,470,670 | 5/1949 | Winkler | 418/23 |
| 2,498,826 | 2/1950 | Ruona | 418/23 |
| 2,684,771 | 7/1954 | Ehrenhaft | 418/23 |
| 3,955,540 | 5/1976 | Blanchard | 418/260 |
| 4,551,080 | 11/1985 | Geiger | 418/267 |

*Primary Examiner*—Carlton R. Croyle
*Assistant Examiner*—Jane E. Obee
*Attorney, Agent, or Firm*—Holman & Stern

[57] ABSTRACT

A fluid pressure-operated device has a rotor mounted inside a main housing, radial slots circumferentially spaced in the rotor, radially sliding vanes in the slots, springs urging the vanes radially inwardly to engage at their inner ends with a cam at the center of the rotor, a control arm pivotally mounted on the housing for changing the position of the cam to control radial displacement of the vanes and opening and closing of a valve having inlet/outlet ports connected to an annular chamber in which the vanes rotate so that fluid pressure from the valve will drive the vanes and thus the rotor in either direction of rotation, depending upon the position of the control arm and cam.

13 Claims, 5 Drawing Figures

OIL-PRESSURE TRANSMISSION DEVICE

BACKGROUND OF THE INVENTION

1. Field of the Invention

This invention relates to an oil or fluid pressure transmission device and more particularly to such a device wherein a sliding vane rotor is driven in either direction of rotation by fluid pressure from a valve controlled easily by simple operation of a control rod.

2. Description of the Prior Art

Conventional oil-pressure transmission devices cannot be adjusted quickly and sensitively in rotating speed and cannot change direction of rotation and they need a controlling valve to control the oil flow of the oil pressure pump for the purpose of adjusting speed.

BRIEF SUMMARY OF THE INVENTION

It is an object of this invention to provide an improved device which overcomes the above problems.

It is a further object of the invention to provide a fluid pressure transmission device wherein fluid pressure acts directly on either side of the vanes of a rotor, the fluid pressure being controlled by a valve, so that the direction of the rotor can be easily and quickly reversed.

The above objectives are accomplished by this invention which consists of a cup-shaped housing closed by a cover plate to provide an inner cylindrical chamber, a rotor in the chamber having radially inwardly urged vanes engaging by roller followers on their inner ends with a substantially elliptically shaped cam which displaces the vanes radially. The cam is shifted with respect to the rotor axis from a central neutral, or non-operating, position to the right or left thereof to control the amount of displacement of the vanes to the right or left, respectively, into an annular space between the rotor and housing in which the pressurized fluid is flowing, the direction of flow being controlled by a valve mounted on the housing with inlet/outlet tubes connected to the annular chamber on opposite sides of a sealing partition. The flow position of the valve and position of the cam are simultaneously controlled by a control arm so that fluid pressure through the valve drives the rotor in either direction and the direction can be quickly reversed by simple shifting of the control arm.

DETAILED DESCRIPTION OF THE INVENTION

Figure 1:
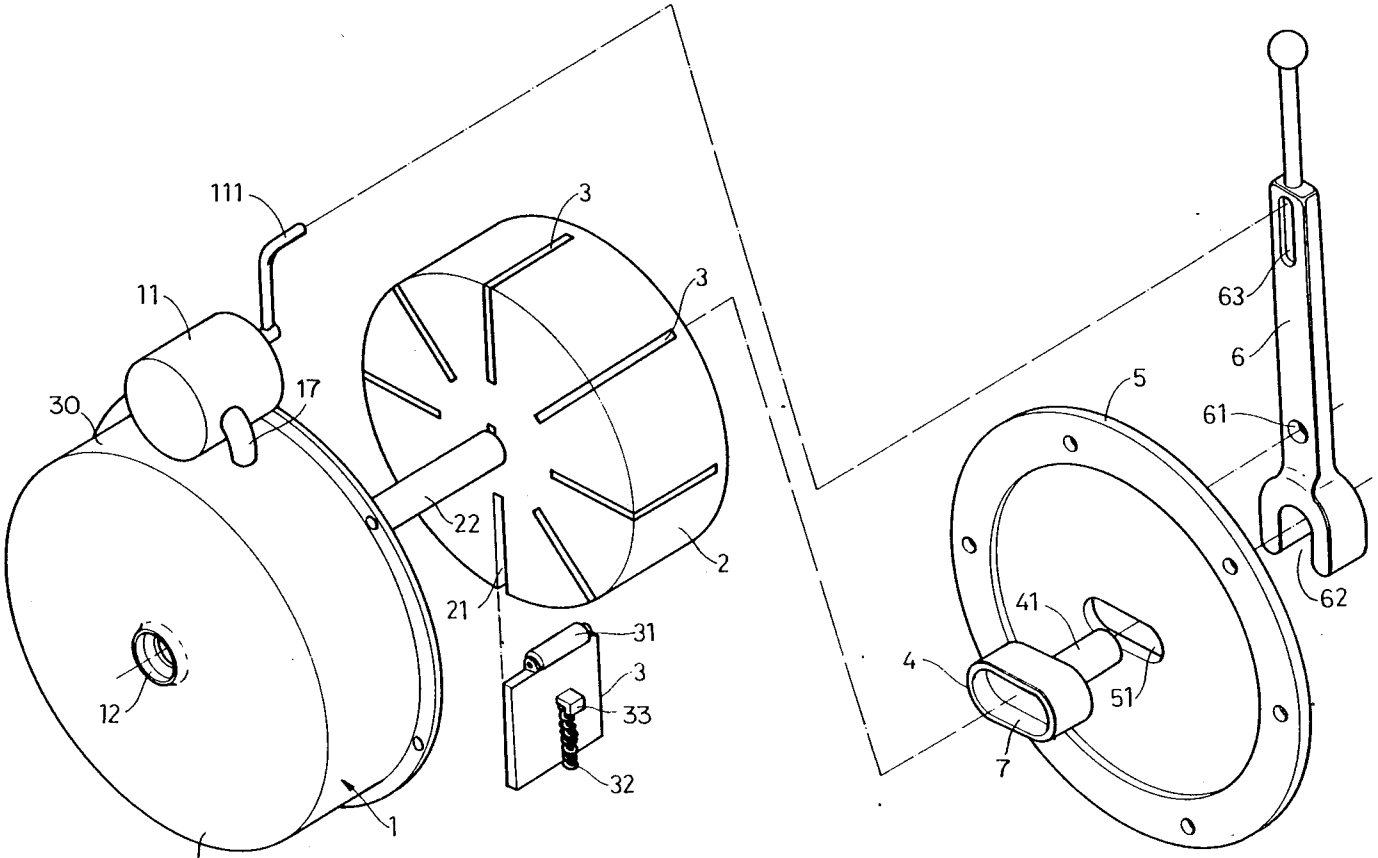
FIG. 1 is a perspective exploded view of the present invention.

As shown in FIG. 1, the present invention consists of a main housing 1, a rotor 2, vanes 3, an elliptical base or cam 4, a cover 5 and a control arm 6.

The main housing is cup-shaped having a radially extending bottom or web part 20 and a cylindrical side wall 30 and includes an oil valve 11 mounted on side wall 20 which surrounds the rotor 2 in radial spaced relationship which rotates inside the housing.

Figure 2:
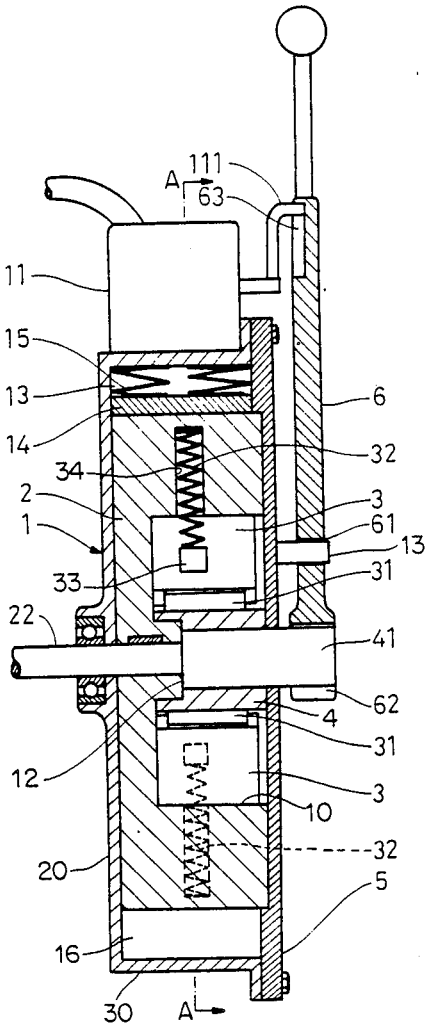
FIG. 2 is a cross-sectional view of the present invention.

The rotor 2 is disposed inside the main housing 1, has a plurality of radial slots 21 and a cylindrical chamber 10 in which the vanes and cam 4 operate. The center of the rotor 2 is fixed onto a shaft 22 which extends axially outwardly through a hole 12 in housing 1. An axially extending boss 12 is provided extending into chamber 10 and engageable in recessed opening 7 in cam 4 as shown in FIG. 2.

Each of the vanes 3 is placed inside one of the slots 21 and can move radially back and forth along the slot. The radially inner end of each vane 3 has a roller 31 mounted thereon. In addition, between L-shaped seat 33 on each vane 3 and the radially outer end of radially extending spring housing openings 34 in rotor 2 adjacent slots 21 is a compressed spring 32 for resiliently urging each vane 3 radially inwardly, as shown in FIGS. 2–5.

The elliptical base or cam 4 is mounted inside rotor 2 and attached to a rod 41 at its center. The rollers 31 of vanes 3 have rolling contact on the outer surface of cam 4 to function as cam followers.

The cover 5 is bolted together with the main housing 1 so as to form a sealed annular chamber 16 within the main housing 1 and closed chamber 10 and has an elliptical hole 51 at its center for the rod 41 of the elliptical cam 4 to extend through.

The control arm 6 is assembled together with the cover 5 via a hole 61 which receives pin 13 extending from cover 5 to function as a pivot center for pivotal movement of control arm 6. The lower end of control arm 6 is shaped as a U-shaped fork 62 which engages with the part of the rod 41 extending outside cover 5. Therefore, when control arm 6 is pivoted about pin 13, the U-shaped fork 62 forces cam 4 to move to the right or left as viewed in FIGS. 3–5. In addition, the upper part of control arm 6 has an elongated slot 63 for receiving the end of a lever 111 of the oil valve 11 so that the control arm 6 also manipulates valve 11 to control the oil-flowing direction as will more clearly be evident from the further description below.

The oil valve 11 used in this invention is the same as a conventional valve used for controlling direction of flow of a common fluid, so it is not described herein because details thereof will be known to those having ordinary mechanical skill in this field.

Figure 3:
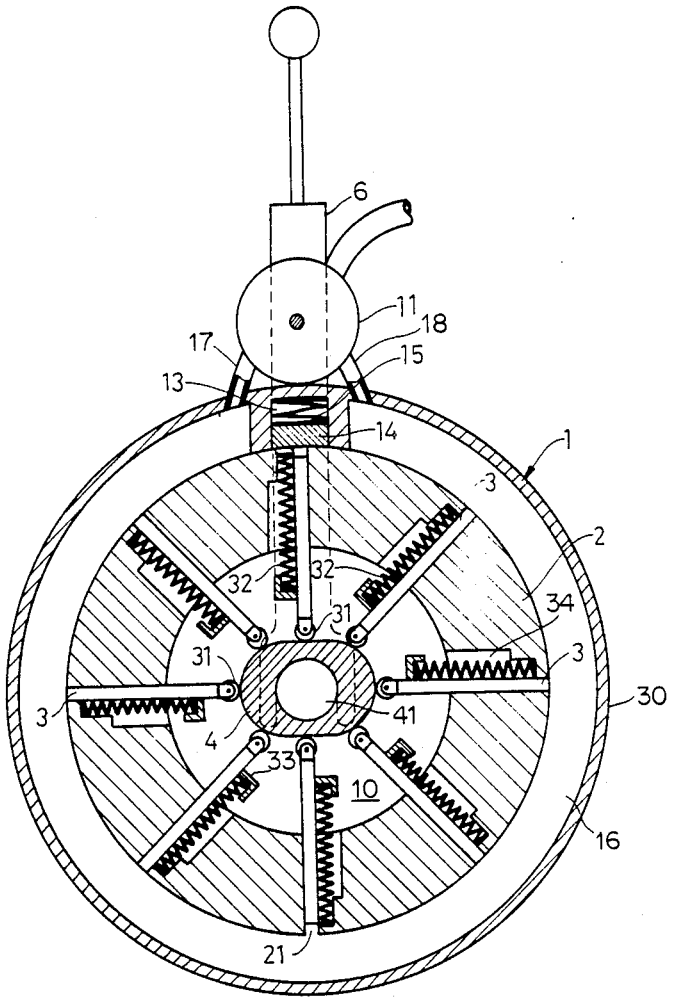
FIG. 3 is a cross-sectional view taken along line A—A of FIG. 2.

Next, in FIGS. 2, 3, we can see that at the upper inside wall of the main housing 1, there is an isolated chamber 13 which contains a slide block 14 and a spring 14 urging slide block 14 into close contacting engagement with the outer surface of rotor 2. Fluid inlet/outlets 17, 18 are provided on opposite sides of the isolated chamber 13 extending through main housing 1 in the form of two separate tubes from valve 11. Of course, the rollers 31 of vanes 3 will always have rolling contact on the outer surface of cam 4 due to the compression of springs 32.

Moreover, FIGS. 2, 3 show structural views of this invention when control arm 6 is in its middle position. Under this condition, vanes 3 all remain within slots 21 of rotor 2 and the valve is closed so that the device is not working.

Figure 4:
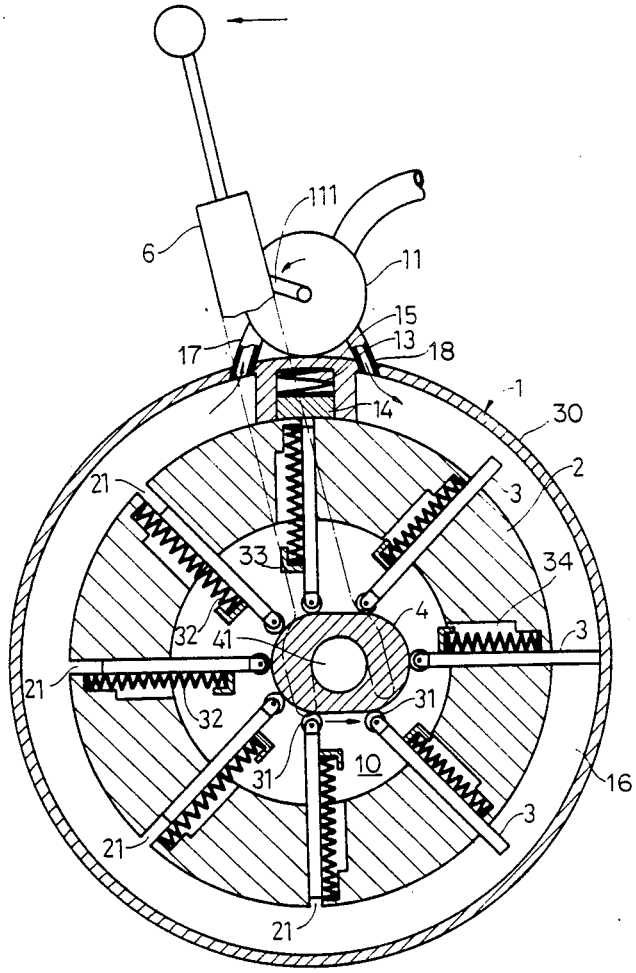
FIG. 4 is a view similar to FIG. 3 showing an example of operating the present invention.
Figure 5:
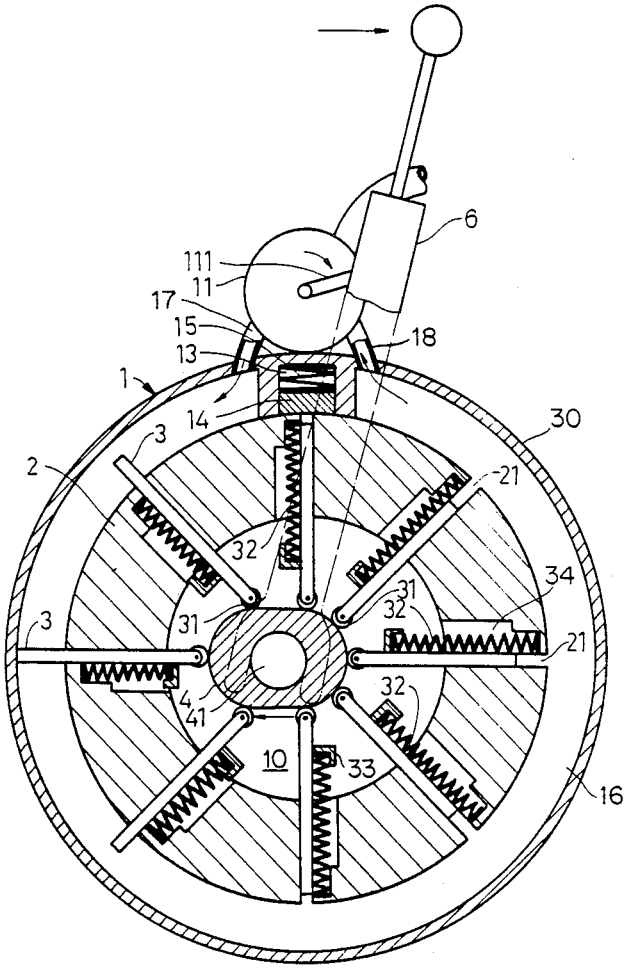
FIG. 5 is a view similar to FIG. 4 showing another example of operating the present invention.

However, when the control arm 6 is moved to the left as shown in FIG. 4, the cam 4 will be moved to the right, so that those vanes 3 to the right of center of cam 4 will extend out of slots 21 into annular chamber 16. In this position fluid will flow into annular chamber 16 through inlet/outlet 18 to the right as viewed in FIG. 4 and drive rotor 2 clockwise together with shaft 22. If control arm 6 is moved to the right as viewed in FIG. 5, cam 4 will be moved to the left and rotor 2 will rotate counter-clockwise with shaft 22.

As described above and illustrated in the Figures, the present invention uses fluid pressure to create a driving force of rotation and, due to the direct contact of the fluid on vanes 3, attains the purpose of quick driving.

What is claimed is:

1. A fluid pressure transmission device comprising:

a cup-shaped main housing member having a base portion and a cylindrical wall portion having a cylindrical internal surface, said base and wall portion forming a rotor chamber;

a rotor rotatably mounted within said rotor chamber on an axis of rotation;

an annular chamber between said rotor and said internal surface of said wall;

an interior cam chamber in said rotor;

a plurality of radial slots in said rotor extending between said cam chamber and the outer periphery of said rotor;

a plurality of radial vanes slidably mounted in said radial slots;

a cover plate attached to said main housing member to close said cam chamber and sealingly close said annular chamber;

an elongated slot through said cover plate;

a cam rod extending through said elongated slot in said cover plate and having an outer extension projecting from the outer surface of said cover plate;

a non-rotatable cam member within said cam chamber and connected to the inner end of said cam rod;

a substantially elliptical outer cam surface on said cam member for displacing said vanes radially and into and out of said annular chamber;

roller cam followers on the radial inner ends of said radial vanes;

means to resiliently urge said radial vanes radially inwardly to retain said followers in engagement with said cam surface;

a control arm pivotally mounted on said cover plate and having an inner part rotatably engageable with said outer extension of said cam rod and an outer part;

an elongated recess in said outer part;

a fluid pressure control valve mounted on said main housing member;

a rotatable valve control lever on said valve having an outer end engageable in said elongated recess;

a partition extending inwardly from said internal surface of said housing cylindrical wall having an inner portion engaging the outer periphery of said rotor to divide said chamber into inlet and outlet portions;

inlet and outlet conduit means connecting said valve with said annular chamber on opposite sides of and adjacent to said partition; and pivot means having a pivot axis for pivotally mounting said control arm on said cover plate, so that rotation of said control arm about said pivot axis simultaneously displaces said cam rod in said elongated slot and said cam member therewith in said cam chamber and said valve control lever, so that fluid pressure from said valve flows through said annular chamber to selectively drive said rotor via said vanes in either direction depending on the position of said control arm.

2. A fluid pressure transmitter as claimed in claim 1 wherein said means to resiliently urge said radial vanes radially inwardly comprises:

radially extending openings in said rotor adjacent said slots having radially outer ends;

abutment members on said radial vanes; and compression spring means in said openings each having an outer end engaging a radially outer end of a respective opening and an inner end engaging a respective abutment member.

3. A fluid pressure transmission device as claimed in claim 1 wherein:

said valve control lever comprises an L-shaped portion having an outer leg on which said outer end is disposed offset with respect to the axis of rotation of said valve control lever, said outer end being slidably engageable in said elongated recess in said control arm so that said rotation of said control arm causes said outer end to slide in said elongated recess to rotate said valve control lever.

4. A fluid pressure transmission device as claimed in claim 1 wherein said partition comprises:

a substantially radially extending member;

a substantially radially extending opening in said partition member;

a sealing member slidably mounted in said partition opening having a radially inner surface in sliding engagement with the outer periphery of said rotor, and a radially outer surface; and compression spring means in said partition opening engaging said radially outer surface of said sealing member for resiliently urging said sealing member radially inwardly into sealing engagement with the outer periphery of said rotor.

5. A fluid pressure transmission device as claimed in claim 1 wherein:

said cam surface has a central axis which coincides with said rotor axis when said cam member is in a central position; and said cam surface is defined by end portions and a central portion between said end portions, said end portions having a predetermined radius with respect to the central axis of said cam surface of sufficient size so that when said cam surface axis is in a maximum displacement position with respect to said rotor axis, said vanes are radially outwardly displaced a maximum amount in the direction of displacement of said cam surface axis from said rotor axis, and said central portion has a smaller radius with respect to said central axis of said cam surface so that the radially outer ends of said vanes are disposed within said slots when said vanes pass said partition.

6. A fluid pressure transmission device as claimed in claim 1 and further comprising:

a radially extending base on said rotor;

a cylindrical boss extending from said base on said rotor coaxially with said axis of rotation and axially inwardly into said cam chamber; and an axially extending elongated recess in the inner end of said cam member facing said rotor base, said boss engaging in sliding relationship in said cam member recess for supporting and guiding said cam member at said inner end.

7. A fluid pressure transmission device as claimed in claim 6 and further comprising:

a rotor shaft non-rotatably connected to said boss and extending through said base portion of said main housing member; and bearing means in said base portion rotatably supporting said rotor shaft.

8. A fluid pressure transmitter as claimed in claim 6 wherein said means to resiliently urge said radial vanes radially inwardly comprises:

radially extending openings in said rotor adjacent said slots having radially outer ends;

abutment members on said radial vanes; and compressing spring means in said openings each having an outer end engaging a radially outer end of a respective opening and an inner end engaging a respective abutment member.

9. A fluid pressure transmission device as claimed in claim 8 wherein:

said cam surface has a central axis which coincides with said rotor axis when said cam member is in a central position; and said cam surface is defined by end portions and a central portion between said end portions, said end portions having a predetermined radius with respect to the central axis of said cam surface of sufficient size so that when said cam surface axis is in a maximum displacement position with respect to said rotor axis, said vanes are radially outwardly displaced a maximum amount in the direction of displacement of said cam surface axis from said rotor axis, and said central axis of said cam surface so that the radially outer ends of said vanes are disposed within said slots when said vanes pass said partition.

10. A fluid pressure transmission device as claimed in claim 8 wherein:

said valve control lever comprises an L-shaped portion having an outer leg on which said outer end is disposed offset with respect to the axis of rotation of said valve control lever, said outer end being slidably engageable in said elongated recess in said control arm so that said rotation of said control arm causes said outer end to slide in said elongated recess to rotate said valve control lever.

11. A fluid pressure transmission device as claimed in claim 10 wherein said partition comprises:

a substantially radially extending member;

a substantially radially extending opening in said partition member;

sealing member slidably mounted in said partition opening having a radially inner surface in sliding engagement with the outer periphery of said rotor, and a radially outer surface; and compression spring means in said partition opening engaging said radially outer surface of said sealing member for resiliently urging said sealing member radially inwardly into sealing engagement with the outer periphery of said rotor.

12. A fluid pressure transmission device as claimed in claim 11 wherein:

said cam surface has a central axis which coincides with said rotor axis when said cam member is in a central position; and said cam surface is defined by end portions and a central portion between said end portions, said end portions having a predetermined radius with respect to the central axis of said cam surface of sufficient size so that when said cam surface axis is in a maximum displacement position with respect to said rotor axis, said vanes are radially outwardly displaced a maximum amount in the direction of displacement of said cam surface axis from said rotor axis, and said central axis of said cam surface so that the radially outer ends of said vanes are disposed within said slots when said vanes pass said partition.

13. A fluid pressure transmission device as claimed in claim 12 and further comprising:

a rotor shaft non-rotatably connected to said boss and extending through said base portion of said main housing member; and bearing means in said base portion rotatably supporting said rotor shaft.

* * * * *